US009322516B2

(12) United States Patent
Boomgaarden et al.

(10) Patent No.: US 9,322,516 B2
(45) Date of Patent: Apr. 26, 2016

(54) LUMINAIRE HAVING VENTED OPTICAL CHAMBER AND ASSOCIATED METHODS

(71) Applicant: Lighting Science Group Corporation, Satellite Beach, FL (US)

(72) Inventors: Mark Penley Boomgaarden, Satellite Beach, FL (US); Eric Holland, Indian Harbour Beach, FL (US); Rick LeClair, Indian Harbour Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 373 days.

(21) Appl. No.: 14/074,173

(22) Filed: Nov. 7, 2013

(65) Prior Publication Data

US 2014/0133153 A1 May 15, 2014

Related U.S. Application Data

(60) Provisional application No. 61/723,491, filed on Nov. 7, 2012.

(51) Int. Cl.

| | |
|---|---|
| ***F21V 29/00*** | (2015.01) |
| ***F21K 99/00*** | (2010.01) |
| ***F21V 29/83*** | (2015.01) |
| *F21V 3/00* | (2015.01) |
| *F21Y 101/02* | (2006.01) |

(52) U.S. Cl.

CPC ..... *F21K 9/135* (2013.01); *F21V 29/83* (2015.01); *F21V 3/00* (2013.01); *F21Y 2101/02* (2013.01)

(58) Field of Classification Search

CPC ..... F21V 29/83; F21V 3/00; F21K 9/135; F21Y 2101/02

See application file for complete search history.

(56) References Cited

U.S. PATENT DOCUMENTS

| | | | |
|---|---|---|---|
| 5,057,908 | A | 10/1991 | Weber |
| 5,523,878 | A | 6/1996 | Wallace et al. |
| 5,704,701 | A | 1/1998 | Kavanagh et al. |

(Continued)

FOREIGN PATENT DOCUMENTS

| | | |
|---|---|---|
| EP | 0851260 | 7/1998 |
| EP | 2410240 | 1/2012 |
| WO | WO 2012135173 | 10/2012 |

OTHER PUBLICATIONS

U.S. Appl. No. 13/832,900, filed Mar. 2013, Holland et al.

Arthur P. Fraas, Heat Exchanger Design, 1989, p. 60, John Wiley & Sons, Inc., Canada.

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

(Continued)

*Primary Examiner* — Thomas M Sember

(74) *Attorney, Agent, or Firm* — Mark Malek; Stephen Bullock; Widerman Malek, PL

(57) ABSTRACT

A luminaire may include an electrical base, an optic defining an optical chamber, an intermediate member that may be positioned between the electrical base and the optic, and a light source. The intermediate member may include a main body and a plurality of structural supports that may be connected to the main body which may be configured to carry an upper member. A plurality of voids may be positioned between the respective plurality of structural supports to position the optical chamber in optical communication with the environment surrounding the luminaire therethrough. The upper member may be configured to carry the optic and the light source may be electrically coupled to the electrical base and may be positioned within the optical chamber. The optic may be configured to redirect at least a portion of light incident thereupon in the direction of the plurality of voids.

21 Claims, 6 Drawing Sheets

(56) References Cited

U.S. PATENT DOCUMENTS 5,813,753 A 9/1998 Vriens et al.
5,997,150 A 12/1999 Anderson
6,140,646 A 10/2000 Busta et al.
6,341,876 B1 1/2002 Moss et al.
6,356,700 B1 3/2002 Strobl
6,561,656 B1 5/2003 Kojima et al.
6,594,090 B2 7/2003 Kruschwitz et al.
6,707,611 B2 3/2004 Gardiner et al.
6,733,135 B2 5/2004 Dho
6,767,111 B1 7/2004 Lai
6,787,999 B2 9/2004 Stimac et al.
6,799,864 B2 10/2004 Bohler et al.
6,817,735 B2 11/2004 Shimizu et al.
6,870,523 B1 3/2005 Ben-David et al.
6,871,982 B2 3/2005 Holman et al.
6,967,761 B2 11/2005 Starkweather et al.
6,974,713 B2 12/2005 Patel et al.
7,042,623 B1 5/2006 Huibers et al.
7,070,281 B2 7/2006 Kato
7,072,096 B2 7/2006 Holman et al.
7,075,707 B1 7/2006 Rapaport et al.
7,083,304 B2 8/2006 Rhoads
7,178,941 B2 2/2007 Roberge et al.
7,184,201 B2 2/2007 Duncan
7,187,484 B2 3/2007 Mehrl
7,213,926 B2 5/2007 May et al.
7,246,923 B2 7/2007 Conner
7,247,874 B2 7/2007 Bode et al.
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,325,956 B2 2/2008 Morejon et al.
7,342,658 B2 3/2008 Kowarz et al.
7,344,279 B2 3/2008 Mueller et al.
7,349,095 B2 3/2008 Kurosaki
7,353,859 B2 4/2008 Stevanovic et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,434,946 B2 10/2008 Huibers
7,438,443 B2 10/2008 Tatsuno et al.
7,476,016 B2 1/2009 Kurihara
7,520,642 B2 4/2009 Holman et al.
7,530,708 B2 5/2009 Park
7,537,347 B2 5/2009 Dewald
D593,963 S 6/2009 Plonski et al.
7,540,616 B2 6/2009 Conner
7,545,569 B2 6/2009 Cassarly
7,556,406 B2 7/2009 Petroski et al.
7,598,686 B2 10/2009 Lys et al.
7,605,971 B2 10/2009 Ishii et al.
7,626,755 B2 12/2009 Furuya et al.
7,677,736 B2 3/2010 Kasazumi et al.
7,684,007 B2 3/2010 Hull et al.
7,703,943 B2 4/2010 Li et al.
7,705,810 B2 4/2010 Choi et al.
7,709,811 B2 5/2010 Conner
7,719,766 B2 5/2010 Grasser et al.
7,728,846 B2 6/2010 Higgins et al.
7,732,825 B2 6/2010 Kim et al.
7,748,870 B2 7/2010 Chang et al.
7,762,315 B2 7/2010 Shen
7,766,490 B2 8/2010 Harbers et al.
7,819,556 B2 10/2010 Heffington et al.
7,824,075 B2 11/2010 Maxik et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,841,714 B2 11/2010 Grueber
7,845,823 B2 12/2010 Mueller et al.
7,871,839 B2 1/2011 Lee
7,880,400 B2 2/2011 Zhoo et al.
7,889,430 B2 2/2011 El-Ghoroury et al.
7,906,722 B2 3/2011 Fork et al.
7,906,789 B2 3/2011 Jung et al.
7,922,356 B2 4/2011 Maxik et al.
7,923,748 B2 4/2011 Ruffin
7,928,565 B2 4/2011 Brunschwiler et al.
7,972,030 B2 7/2011 Li
7,976,205 B2 7/2011 Grotsch et al.
8,016,443 B2 9/2011 Falicoff et al.
8,021,019 B2 9/2011 Chen et al.
8,040,070 B2 10/2011 Myers et al.
8,047,660 B2 11/2011 Penn et al.
8,049,763 B2 11/2011 Kwak et al.
8,061,857 B2 11/2011 Liu et al.
8,070,302 B2 12/2011 Hatanaka et al.
8,076,680 B2 12/2011 Lee et al.
8,083,364 B2 12/2011 Allen
8,096,668 B2 1/2012 Abu-Ageel
8,115,419 B2 2/2012 Given et al.
8,125,776 B2 2/2012 Alexander et al.
8,188,687 B2 5/2012 Lee et al.
8,274,089 B2 9/2012 Lee
8,297,783 B2 10/2012 Kim
8,310,171 B2 11/2012 Reisenauer et al.
8,319,445 B2 11/2012 McKinney et al.
8,322,889 B2 12/2012 Petroski
8,324,823 B2 12/2012 Choi et al.
8,324,840 B2 12/2012 Shteynberg et al.
8,331,099 B2 12/2012 Geissler et al.
8,337,029 B2 12/2012 Li
8,384,984 B2 2/2013 Maxik et al.
8,410,717 B2 4/2013 Shteynberg et al.
8,410,725 B2 4/2013 Jacobs et al.
8,427,590 B2 4/2013 Raring et al.
8,441,210 B2 5/2013 Shteynberg et al.
8,465,167 B2 6/2013 Maxik et al.
8,531,126 B2 9/2013 Kaihotsu et al.
8,545,034 B2 10/2013 Maxik et al.
8,598,799 B2 12/2013 Tai et al.
8,608,341 B2 12/2013 Boomgaarden et al.
8,616,736 B2 12/2013 Pan
8,662,672 B2 3/2014 Hikmet et al.
2003/0039036 A1 2/2003 Kruschwitz et al.
2004/0052076 A1 3/2004 Mueller et al.
2005/0218780 A1 10/2005 Chen
2006/0002108 A1 1/2006 Ouderkirk et al.
2006/0002110 A1 1/2006 Dowling et al.
2006/0103777 A1 5/2006 Ko et al.
2006/0164005 A1 7/2006 Sun
2006/0232992 A1 10/2006 Bertram et al.
2006/0285193 A1 12/2006 Kimura et al.
2007/0013871 A1 1/2007 Marshall et al.
2007/0159492 A1 7/2007 Lo et al.
2007/0188847 A1 8/2007 McDonald et al.
2007/0241340 A1 10/2007 Pan
2008/0198572 A1 8/2008 Medendorp
2008/0232084 A1 9/2008 Kon
2008/0258643 A1 10/2008 Cheng et al.
2008/0316432 A1 12/2008 Tejada et al.
2009/0009102 A1 1/2009 Kahlman et al.
2009/0059099 A1 3/2009 Linkov et al.
2009/0059585 A1 3/2009 Chen et al.
2009/0128781 A1 5/2009 Li
2009/0232683 A1 9/2009 Hirata et al.
2009/0273931 A1 11/2009 Ito et al.
2010/0006762 A1 1/2010 Yoshida et al.
2010/0039704 A1 2/2010 Hayashi et al.
2010/0051976 A1 3/2010 Rooymans
2010/0053959 A1 3/2010 Lizerman et al.
2010/0103389 A1 4/2010 McVea et al.
2010/0109499 A1* 5/2010 Vilgiate ..... F21V 3/00 313/1
2010/0165632 A1* 7/2010 Liang ..... F21V 3/00 362/294
2010/0202129 A1 8/2010 Abu-Ageel
2010/0244700 A1 9/2010 Chong et al.

(56) References Cited

U.S. PATENT DOCUMENTS

| | | | | |
|---|---|---|---|---|
| 2010/0259934 | A1* | 10/2010 | Liu | F21V 29/004 362/294 |
| 2010/0270942 | A1 | 10/2010 | Hui et al. | |
| 2010/0277067 | A1* | 11/2010 | Maxik | F21V 3/00 315/32 |
| 2010/0277084 | A1 | 11/2010 | Lee et al. | |
| 2010/0315320 | A1 | 12/2010 | Yoshida | |
| 2010/0320927 | A1 | 12/2010 | Gray et al. | |
| 2010/0321641 | A1 | 12/2010 | Van Der Lubbe | |
| 2011/0012137 | A1 | 1/2011 | Lin et al. | |
| 2011/0080635 | A1 | 4/2011 | Takeuchi | |
| 2012/0201034 | A1 | 8/2012 | Li | |
| 2012/0217861 | A1 | 8/2012 | Soni | |
| 2012/0218774 | A1 | 8/2012 | Livingston | |
| 2012/0268894 | A1 | 10/2012 | Alexander et al. | |
| 2013/0271818 | A1 | 10/2013 | Maxik et al. | |
| 2013/0294071 | A1 | 11/2013 | Boomgaarden et al. | |
| 2013/0294087 | A1 | 11/2013 | Holland et al. | |
| 2013/0296976 | A1 | 11/2013 | Maxik et al. | |
| 2013/0301238 | A1 | 11/2013 | Boomgaarden et al. | |

OTHER PUBLICATIONS

Jones, Eric D., Light Emitting Diodes (LEDs) for General Lumination, an Optoelectronics Industry Development Association (OIDA) Technology Roadmap, OIDA Report, Mar. 2001, published by OIDA in Washington D.C.

J. Y. San, C. H. Huang, M. H, Shu, "Impingement cooling of a confined circular air jet", In t. J. Heat Mass Transf., 1997. pp. 1355-1364, vol. 40.

N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.

S. A Solovitz, L. D. Stevanovic, R. A Beaupre, "Microchannels Take Heatsinks to the Next Level", Power Electronics Technology, Nov. 2006.

Tannith Cattermole, "Smart Energy Class controls light on demand", Gizmag.com, Apr. 18, 2010 accessed Nov. 1, 2011.

Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

* cited by examiner

LUMINAIRE HAVING VENTED OPTICAL CHAMBER AND ASSOCIATED METHODS

RELATED APPLICATIONS

This application claims the benefit under 35 U.S.C. §119 (e) of U.S. Provisional Patent Application Ser. No. 61/723,491 titled LUMINAIRE HAVING VENTED OPTICAL CHAMBER AND ASSOCIATED METHODS, filed on Nov. 7, 2012, the entire contents of which are incorporated herein by reference.

FIELD OF THE INVENTION

The present invention relates to the field of lighting devices and, more specifically, to passive cooling systems for lighting devices that allow heat to be directed away from a light source and for multi-directional lighting devices.

BACKGROUND OF THE INVENTION

This background information is provided to reveal information believed by the applicant to be of possible relevance to the present invention. No admission is necessarily intended, nor should be construed, that any of the preceding information constitutes prior art against the present invention.

As electronic devices operate, they may generate heat. This especially holds true with electronic devices that operate by passing an electrical current through a semiconductor. As the amount of current passed through the electronic device may increase, so may the heat generated from the current flow.

In a semiconductor device, if the heat generated from the device is relatively small, i.e., the current passed through the semiconductor is low, the generated heat may be effectively dissipated from the surface area provided by the semiconductor device. However, in applications wherein a higher current is passed through a semiconductor, the heat generated through operation of the semiconductor may be greater than its capacity to dissipate such heat. In these situations, the addition of a cooling device may be required to provide further heat dissipation capacity.

One type of such a semiconductor device may be lamps that utilize light emitting diodes (LEDs). LED lamps may include a plurality of LEDs mounted to a circuit board, where current passes through the LEDs to produce light. The current, however, produces heat in addition to light. Excess heat may decrease efficiency and may, in fact, damage the LEDs. Such damage may include, for example, decreasing efficiency of the LEDs. Heat helps to facilitate movement of dopants through the semiconductor, which may render the LED less powerful, or even useless. There are many ways to dissipate heat, including the use of heat sinks, but enhancing heat dissipation may help to maintain and, in some cases, enhance efficiency of operation of LED lamps.

Two major types of cooling devices exist—active and passive. An active cooling device may require its own power draw to direct heat and heated fluids away from a heat source. A passive cooling device, however, may provide a pathway for heat and heated fluids to be directed away from a heat source. An active cooling device may, for instance, include a fan, while a passive cooling device may, for instance, be provided by a heat sink.

Typically, a heat sink may provide increased surface area from which heat may be dissipated. This increased heat dissipation capacity may allow a semiconductor to operate at a higher electrical current. Traditionally, a heat sink may be enlarged to provide increased heat dissipation capacity. However, increasing power requirements of semiconductor-based electronic systems may still produce more heat than may be dissipated from a connected heat sink alone. Furthermore, continued enlargement of the heat sink size may not be practical for some applications.

Various light effects are desirable when using LED lamp systems. Due to the use of heat sinks, however, light emission may be somewhat limited. In other words, the emission of light from the LED light source may be limited to an upward and/or outward direction. It would be desirable to provide heat dissipating capabilities to an LED that simultaneously decreases limitations on light emission that currently exist.

An additional problem in the prior art is providing light by the operation of a lamp including semiconductor-based lighting elements in more than 180° of direction, i.e., in greater than an imaginary hemisphere either directly above or directly below the light source. Previously, coating the luminaire enclosure with a reflective material has been used to direct light beyond 180° using reflection techniques. Traditionally more than one reflection is needed to direct the light beyond 180°. In doing this, there is often a decrease in efficiency with each reflection.

Other LED luminaires may emit light in more than 180° of direction. Such luminaires, however, typically have cylindrically-mounted LED boards.

SUMMARY OF THE INVENTION

In view of the foregoing, it is therefore an object of the present invention to provide an improved LED-based lamp for use in a space-limited lamp enclosure, such as a can light fixture. The embodiments of the present invention are related to a lighting device that advantageously allows for increased heat dissipation and emission of light in a number of directions or angles and with varied amounts of light. The lighting device according to an embodiment of the present invention also advantageously provides ease of installation.

With the above in mind, the present invention is directed to a luminaire that may include an electrical base, an optic defining an optical chamber, an intermediate member that may be positioned between the electrical base and the optic, and a light source. The intermediate member may include a main body and a plurality of structural supports that may be connected to the main body and that may be configured to carry an upper member. A plurality of voids may be formed between the respective plurality of structural supports to position the optical chamber in optical communication with the environment surrounding the luminaire therethrough. The upper member may be configured to carry the optic. The light source may be electrically coupled to the electrical base and may be positioned within the optical chamber. The optic may be configured to redirect at least a portion of light incident thereupon in the direction of the plurality of voids.

The luminaire may further include a heat sink that may be carried by or adjacent to the intermediate member. Each of the plurality of voids may be defined by a pair of the structural supports positioned adjacent to one another, the upper member, and an outer surface of the main body. The plurality of voids may be configured to position the optical chamber and/or the heat sink in fluid communication with the environment surrounding the luminaire.

The luminaire may further include a controller to selectively operate the light source. The luminaire may also further include a light source board that may be electrically coupled to the light source and/or the electrical base. The light source board may be configured to facilitate the operation of the light source by the controller. The light source board may be carried by the intermediate member. The luminaire may further include a power supply unit that may be electrically coupled to the electrical base, the light source board, the controller, and/or the light source. The light source may be a plurality of light sources and the light source board may have a circular configuration and the plurality of light sources may be distributed about the light source board.

The light source board may be configured to extend beyond a periphery of the intermediate member and the light source board may include an upper surface and a lower surface such that a region of the lower surface may extend beyond the periphery of the intermediate member. The plurality of light sources may also include a first plurality of light sources and a second plurality of light sources and the first plurality of light sources may be distributed about the upper surface of the light source board and the second plurality of light sources may be distributed about the lower surface of the light source board.

The controller may be adapted to independently operate each of the light sources in each of the first plurality of light sources and/or the second plurality of light sources. The optic may include a conversion material, a refractive material, a reflective material, a silvered surface, a tinted surface, and/or a mirrored surface. The light source may also include a conversion material, a refractive material, and/or a tinted surface.

The light emitted by the light source may be within a wavelength range of at least one of about 10 nanometers to 380 nanometers, about 390 nanometers to 700 nanometers, and about 700 nanometers to 1 millimeter. A portion of the light emitted by the light source may be reflected and/or refracted by the optic in a direction substantially below a generally horizontal plane defined by the upper member. At least a portion of the light emitted by the light source that is reflected and/or refracted by the optic may be reflected and/or refracted in the direction of the void.

The light source may include a light emitting diode (LED). The luminaire may further include an intermediate optic that may be positioned adjacent to the light source and/or carried by the intermediate member and the intermediate optic may be configured to form a fluid seal between the light source and the optical chamber. The intermediate optic may further include a conversion material.

DETAILED DESCRIPTION OF THE PREFERRED EMBODIMENT

Figure 1:
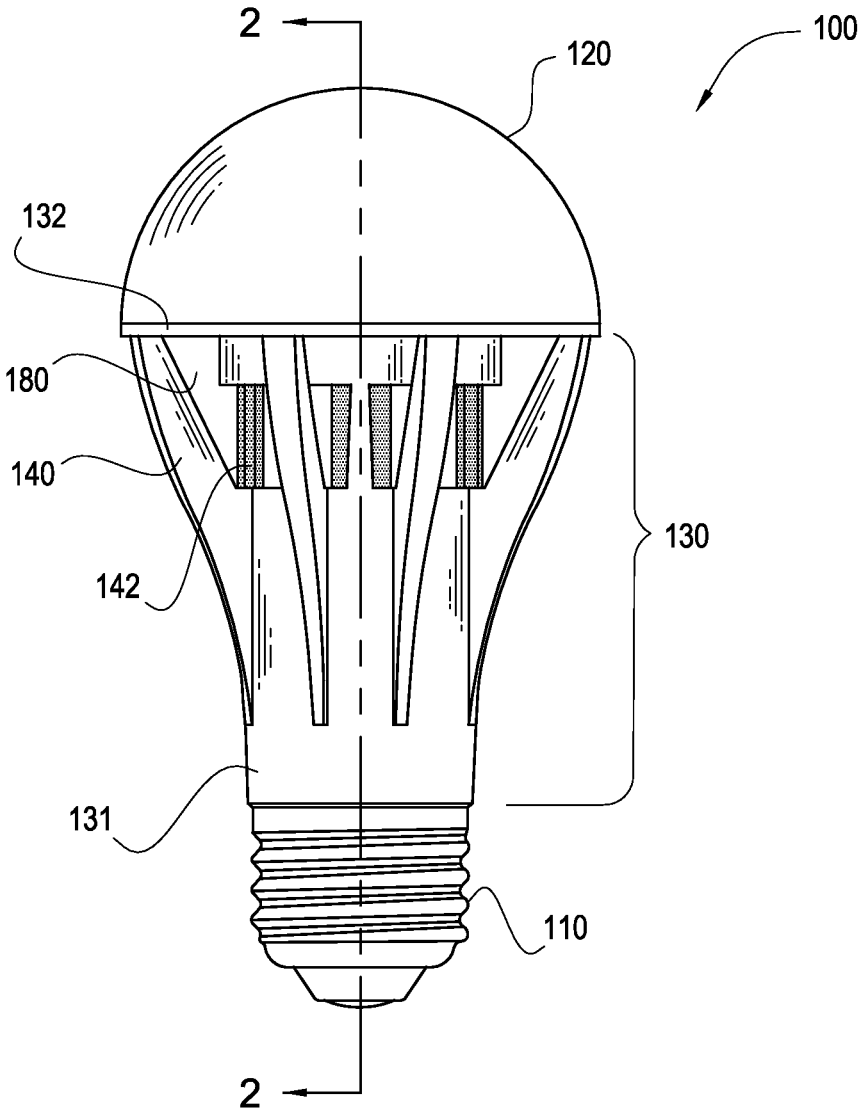
FIG. 1 is a front perspective view of a luminaire according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure. Like numbers refer to like elements throughout.

In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Additionally, in the following detailed description, reference may be made to the driving of light emitting diodes, or LEDs. A person skilled in the art will appreciate that the use of LEDs within this disclosure is not intended to be limited to the any specific form of LED, and should be read to apply to light emitting semiconductors in general. Accordingly, skilled artisans should not view the following disclosure as limited to the any particular light emitting semiconductor device, and should read the following disclosure broadly with respect to the same.

Details regarding a passive heat dissipation system that may be used in connection with luminaires may also be found in U.S. Provisional Patent Application No. 61/642,257 titled LUMINAIRE HAVING A VENTED ENLCOSURE filed on May 3, 2012, the entire contents of which are incorporated herein by reference. Additional details regarding passive heat dissipation systems used in connection with luminaires may be found in U.S. Design patent application Ser. No. 29/419,304, titled VENTED LUMINAIRE HAVING MEDIALLY DISPOSED ENCLOSURE, U.S. Design patent application Ser. No. 18/419,308, titled LUMINAIRE WITH VENTED ENCLOSURE, U.S. Design patent application Ser. No. 29/419,314, titled LUMINAIRE WITH PRISMATIC ENCLOSURE, U.S. Design patent application No. 29/419,312, titled LUMINAIRE WITH MEDIAL ENCLOSURE AND HEAT SINK, and U.S. Design patent application Ser. No. 29/419,310, titled LUMINAIRE WITH VENTED ENCLOSURE AND HEAT SINK, the entire contents of each of which are incorporated herein by reference. Details regarding active heat dissipation systems used in connection with luminaires may also be found in U.S. Design patent application Ser. No. 13/107,782, titled SOUND BAFFLING COOLING SYSTEM FOR LED THERMAL MANAGEMENT AND ASSOCIATED METHODS and U.S. Design patent application Ser. No. 13/461,333, titled SEALED ELECTRICAL DEVICE WITH COOLING SYSTEM AND ASSOCIATED METHODS, the entire contents of each of which are incorporated herein by reference.

Figure 2:
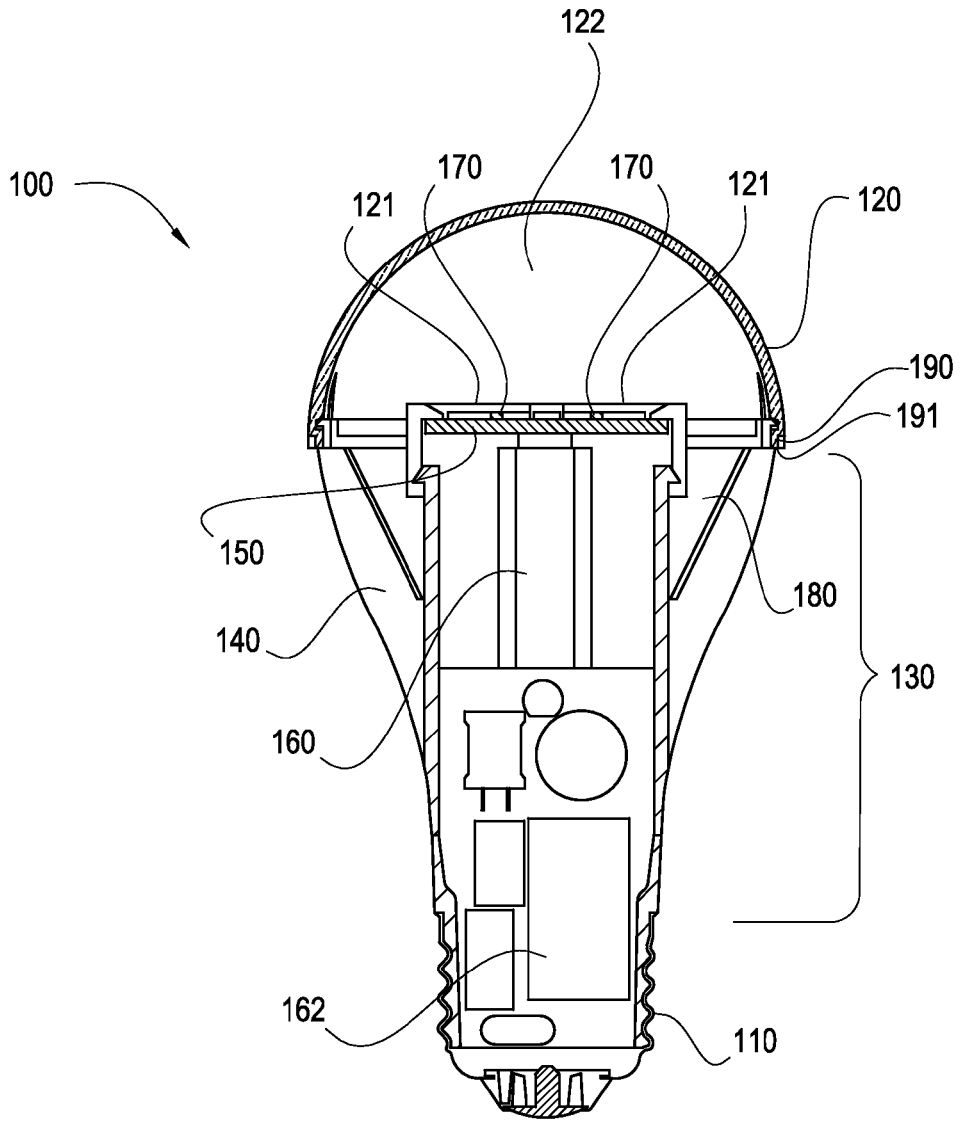
FIG. 2 is a cross-sectional view of the luminaire illustrated in FIG. 1 taken through line 2-2.
Figure 3:
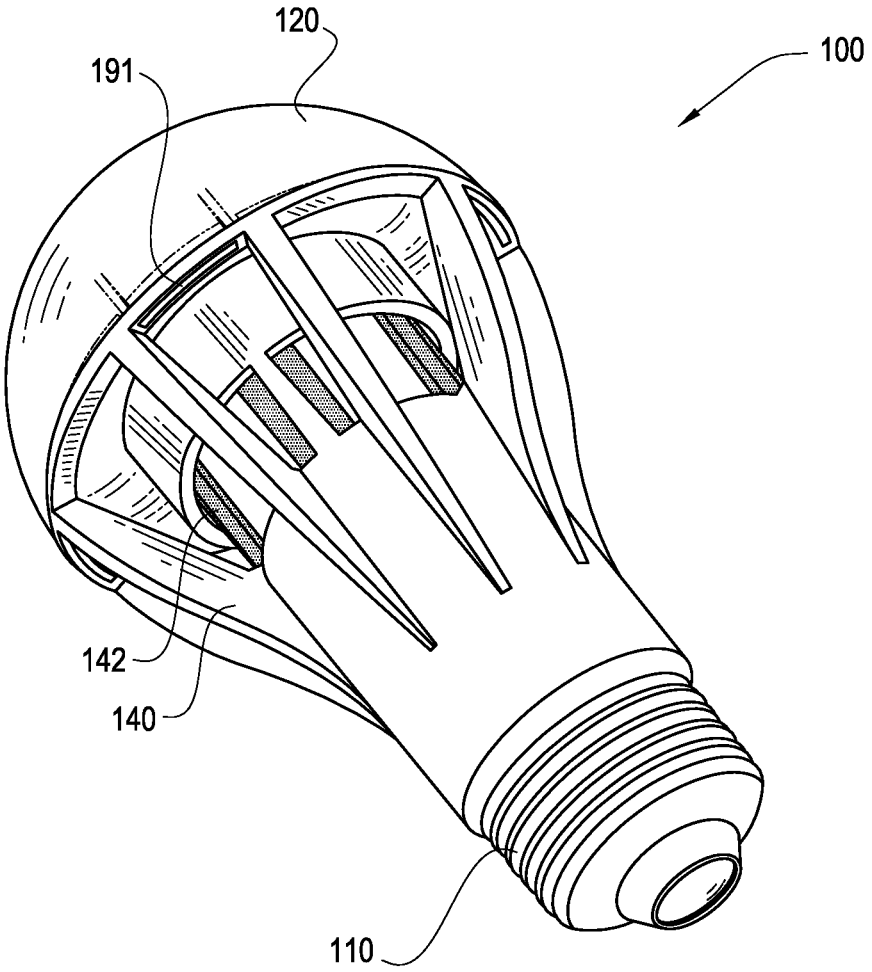
FIG. 3 is a perspective view of the luminaire illustrated in FIG. 1.
Figure 4:
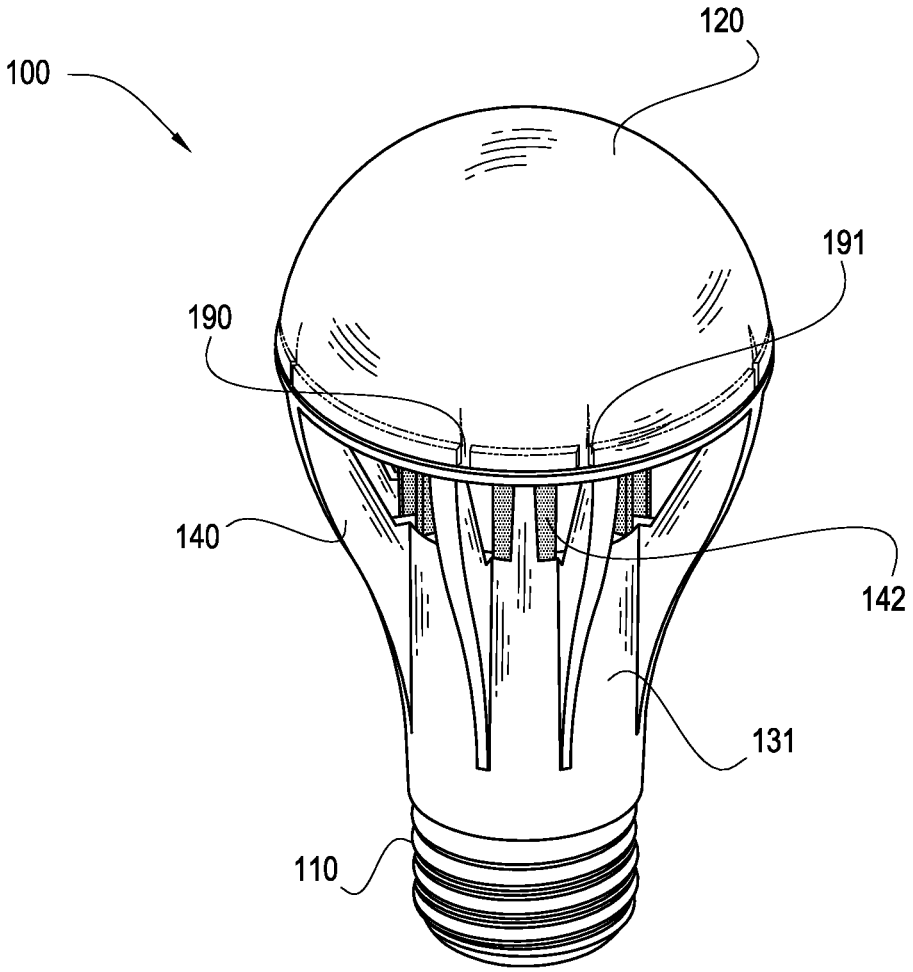
FIG. 4 is a top perspective view of the luminaire illustrated in FIG. 1.

Referring now to FIGS. 1-4, a luminaire 100 having a venting system will now be discussed. As shown in FIGS. 1, 3, and 4, the luminaire 100 may have an electrical base 110, an optic 120, and an intermediate member 130 between the electrical base 110 and the optic 120. The optic 120 may be configured, shaped, and dimensioned so as to define an optical chamber 122. The intermediate member 130 may include structural supports 140 as illustrated, which may be configured to engage with and carry the optic 120. The intermediate member 130 may also include a main body 131 and the plurality of structural supports 140 that may be connected to the main body 131 and may be configured to carry an upper member 132. The upper member 132 may be configured to carry the optic 120.

For example, the optic 120 may be carried by the intermediate member 130, the main body 131, the upper member 132, or the structural supports 140 through the use of an adhesive, a glue, a slot and tab system, or any other attachment method known in the art. More specifically, for example and as illustrated in FIGS. 2-6, the upper member 132 may include a plurality of slots 191 and the optic 120 may include a plurality of tabs 190 that fit into the plurality of slots 191 to fasten the optic 120 in place, thereby inhibiting the optic 120 from rotating or from separating vertically from the upper member 132. For example, the optic 120 may be carried by the intermediate member 130, the upper member 132, or the structural supports 140 through the use of an adhesive, a glue, a slot and tab system, welding, ultrasonic welding, or any other attachment method known in the art. A skilled artisan will also appreciate, after having the benefit of this disclosure, additional devices and methods for fastening the optic 120 to the upper member 132 that may be used.

The intermediate member 130 may include a heat sink 142. The heat sink 142 may be carried by or adjacent to the intermediate member 130 and the heat sink 142 may facilitate passive cooling of the luminaire 100. The heat sink 142 may be positioned adjacent the intermediate member 130 or, in some embodiments, be included in the intermediate member 130. A plurality of voids 180 may exist within the intermediate member 130 and may be defined by the space between the structural supports 140 themselves, and between structural supports 140 and the heat sink 142. Additionally, each of the plurality of voids 180 may be defined by a pair of the structural supports 140 positioned adjacent to one another, the upper member 132, and the outer surface of the main body 131. The plurality of voids 180 may be configured to position the optical chamber 122 and/or the heat sink 142 in fluid communication with the environment surrounding the luminaire 100.

Those skilled in the art will appreciate that the heat sink 142 may be integrally molded with the intermediate member 130, or may be of separate construction. In a case where the heat sink 142 is a separate construction from the intermediate member 130, those skilled in the art will appreciate that the heat sink 142 may be adapted to engage a portion of the intermediate member 130. In other words, it is contemplated by the present invention that the heat sink 142 may be a removable heat sink that may be engaged and disengaged from the intermediate member 130.

As illustrated in the cross section view of FIG. 2, the luminaire 100 may include one or more light source 170. The light source 170 may be disposed within the optical chamber 122 defined by the optic 120 and be in electrical communication with the electrical base 110. The luminaire 100 may further include a light source board 150 and a controller 160, wherein the controller 160 may be configured to selectively operate the light source 170, and wherein the light source board 150 is configured to enable the operation of the light source 170 by the controller 160. The light source board 150 and controller 160 may be housed in and/or carried by the intermediate member 130, and in electrical communication with the electrical base 110 and/or the light source 170. This configuration may be particularly advantageous, as the light source 170, the light source board 150, and the controller 160 may benefit from the cooling effects of the heat sink 142 as shown in FIG. 2. Other configurations may readily present themselves to such skilled artisans having had the benefit of this disclosure, and are intended to be included within the scope and spirit of the present invention.

The luminaire 100 may further include a power supply unit 162 positioned in electrical communication with the electrical base 110, the light source board 150, the controller 160, and the light source 170. The power supply unit 162 may include circuitry and electrical components so as to receive voltage from an external power source via the electrical base 110 and transform, condition, modulate, and otherwise alter the voltage received via the electrical base 110 into one or more voltages necessary for the operation of the various electrical elements of the luminaire 100, including, without limitation, the light source board 150, controller 160, and light source 170.

Heat sinks function by allowing heat from a heat source to be dissipated over a larger surface area. For this reason, ideal heat sinks may be made of materials having high heat conductivity. High heat conductivity may allow the heat sink 142 to readily accept heat from a heat source, cooling the heat source faster than the surface area of the heat source alone. Accordingly, this embodiment of the luminaire 100 advantageously utilizes the heat sink 142 to dissipate heat generated by various elements of the luminaire 100, such as the light source 170, light source board 150, controller 160, and power supply unit 162.

Continuing to refer to FIG. 2, additional details of the luminaire 100 are now discussed. More specifically, the light source board 150 and the controller 160 may be in electrical communication with the electrical base 110, and may be housed within the intermediate member 130. The light source 170 may be disposed within the optical chamber 122 defined by the optic 120 adjacent to the intermediate member 130, and may be in electrical communication with the power supply unit 162. Although the light source 170 is illustrated as a plurality of lighting devices in an array, the light source 170 may be a single lighting device, or a plurality of lighting devices in any number of configurations, as will be discussed below.

Although LEDs have been mentioned specifically for use as the light source 170 within the optic 120, the present invention advantageously contemplates the use of any light source 170 as any type of light source may benefit from the circulation provided by the heat sink 142 and, more specifically, provided by the venting capabilities of the luminaire according to the present invention. These potential light sources 170 include, but are not necessarily limited to, incandescent light bulbs, CFL bulbs, semiconductor lighting devices, LEDs, infrared lighting devices, or laser-driven lighting sources. Additionally, more than one type of lighting device may be used to provide the light source 170.

A conversion coating may be applied to the light source 170 or optic 120 to create a desired output color. The inclusion of a conversion coating may advantageously allow the luminaire 100 of the present invention to include high efficiency/efficacy LEDs, increasing the overall efficiency/efficacy of the luminaire 100 according to an embodiment of the present invention. Additionally, conversion coatings may be applied, such as a conversion phosphor, delay phosphor, or quantum dot, to condition or increase the light outputted by the light source 170. For example, the optic 120 may include a conversion material, a refractive material, a reflective material, a silvered surface, a tinted surface, and/or a mirrored surface. The light source 170 may also include a conversion material, a refractive material, and/or a tinted surface. Additional details of such conversion coatings are found in U.S. patent application Ser. No. 13/357,283, titled Dual Characteristic Color Conversion Enclosure and Associated Methods, filed on Jan. 24, 2012, as well as U.S. patent application Ser. No. 13/234,371, titled Color Conversion Occlusion and Associated Methods, filed on Sep. 16, 2011, and U.S. patent application Ser. No. 13/234,604, titled Remote Light Wavelength Conversion Device and Associated Methods, the entire contents of each of which are incorporated herein by reference.

An example of the inclusion of a conversion coating will now be provided, without the intention to limit the luminaire 100 of the present invention. In this example, the source wavelength range of the light generated by the light source 170 may be emitted in a blue wavelength range. However, a person of skill in the art, after having the benefit of this disclosure, will appreciate that LEDs capable of emitting light in any wavelength ranges may be used in the light source 170, in accordance with this disclosure of the present invention. A skilled artisan will also appreciate, after having the benefit of this disclosure, additional light generating devices that may be used in the light source 170 that may be capable of creating an illumination.

Continuing with the present example of the light source 170 with a conversion coating applied, the light source 170 may generate a source light with a source wavelength range in the blue spectrum. The blue spectrum may include light with a wavelength range between 400 and 500 nanometers. A source light in the blue spectrum may be generated by a light-emitting semiconductor that is comprised of materials that may emit a light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). A person skilled in the art will appreciate that, although the preceding semiconductor materials have been disclosed herein, any semiconductor device capable of emitting a light in the blue spectrum is intended to be included within the scope of the present invention.

The conversion coating may be a phosphor substance, which may be applied to the blue LEDs. The phosphor substance may absorb wavelength ranges emitted by the LEDs and emit light defined in additional wavelength ranges when energized. Energizing of the phosphor may occur upon exposure to light, such as the source light emitted from the light source 170. The wavelength of light emitted by a phosphor may be dependent on the materials from which the phosphor is comprised.

Continuing with the present example of the light source 170 with a conversion coating applied, the optic 120 may be coated with a refractive/reflective material. The reflective material may provide additional light in a downward direction and may only require one reflection. The optic 120 may provide additional light in an outward direction with respect to the light source 170 and may require only one refraction. The emitted light may be increased due to the void 180 between the support structures 140. A person skilled in the art will appreciate that the use of the coating material within this disclosure is not intended to be limited to any specific type of coating. Accordingly, skilled artisans should not view the following disclosure as limited to the any particular reflective coating, and should read the following disclosure broadly with respect to the same.

Figure 5:
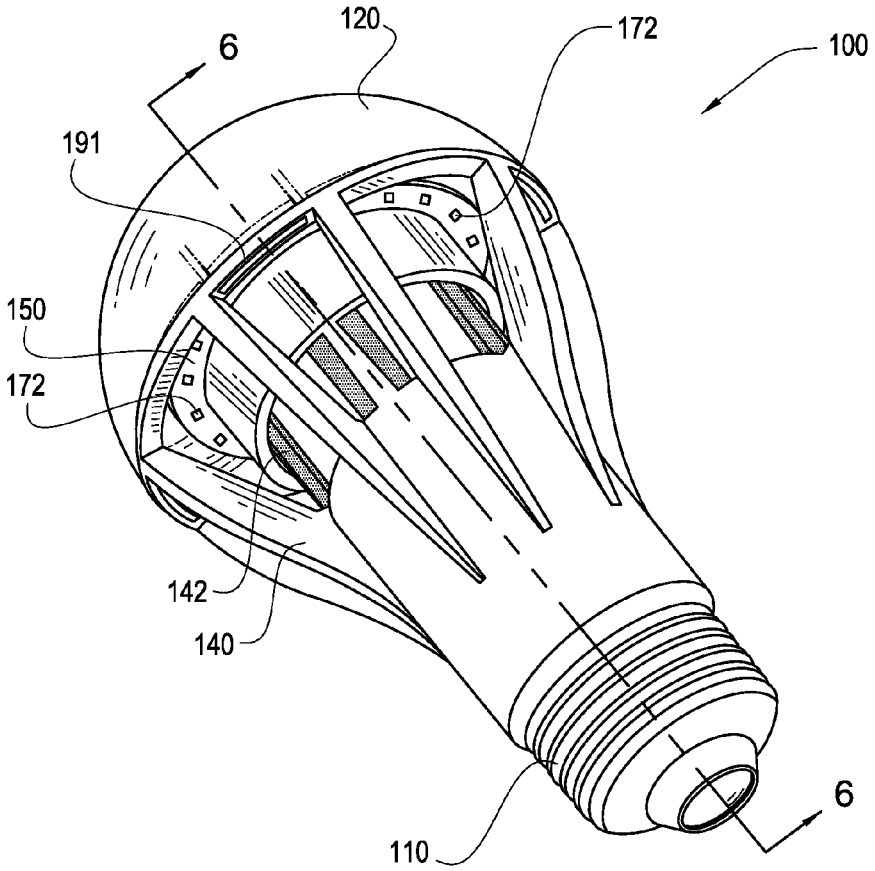
FIG. 5 is a perspective view of a luminaire according to another embodiment of the present invention.

For example, the light source 170 may be mounted on the light source board 150 which may be a flat-mounted LED board and may require only one reflection/refraction. The light source 170 may also be mounted on the light source board 150, which may be a cylindrically-mounted LED board and may require only one reflection/refraction. This may also propagate light in all or nearly all directions including both the upper and lower hemispheres from the light source 170. The light source 170 may be electrically coupled to the electrical base 110 and may be positioned within the optical chamber 122. The light source 170 may be a plurality of light sources 170 and the light source board 150 may have a circular configuration and the plurality of light sources 170 may be distributed about the light source board 150. For example and as illustrated in FIG. 5, the light source 170 may be annularly distributed about the light source board 150.

The optic 120 may be a curved surface concavely curved with respect to the light source 170. As examples, the optic 120 may be white or a color or the surface may be silvered, tinted, or mirrored (mirror finish). The optic 120 may include one or more media of differing reflective and refractive indices. The optic 120 may be, for example, one or more Fresnel lenses. The optic 120 may reflect all light, no light, or any proportion in between. For example, the optic 120 may be configured to redirect at least a portion of light incident thereupon in the direction of the plurality of voids 180. The optic 120 may be formed of any material, for example, glass, acrylic, or plastic.

Figure 6:
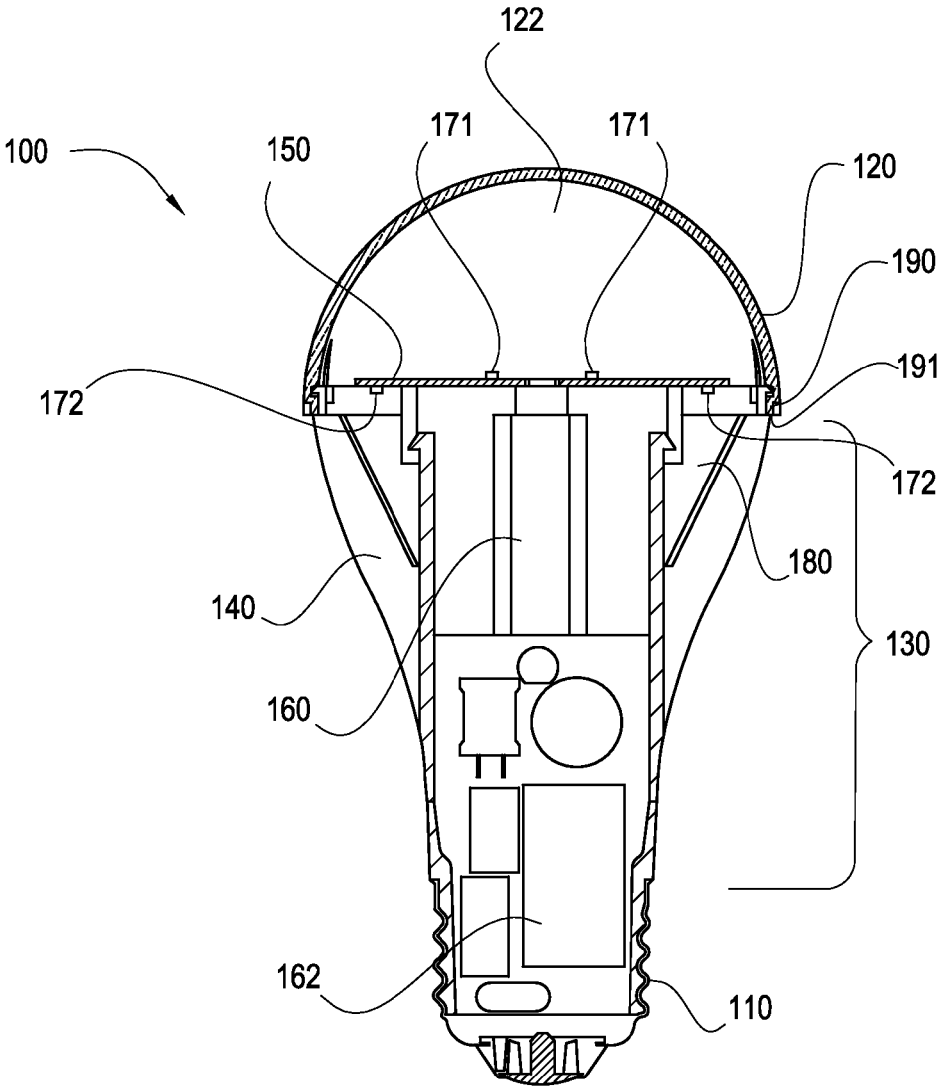
FIG. 6 is a cross-sectional view of the luminaire illustrated in FIG. 5 taken through line 6-6.

As perhaps best illustrated in FIGS. 2 and 6, the void 180 may allow light from the light source 170 to propagate downward to the lower hemisphere in a direction toward the electrical base and outward away from the heat sink 142 and the light source 170 after being reflected/refracted by the optic 120. The void 180 additionally may allow air flow between at least one of the optic 120, the structural support members 140, the heat sink 142, and the light source 170. Air flow through the void 180 may allow the heat sink 142 to cool more efficiently, for example by allowing heated air to flow faster away from at least one of the luminaire 100 in general, the heat sink 142, the light source board 150, the controller 160, and the light source 170. Additionally, air flow through the optical chamber 122 and the dissipation of heat thereby may reduce the quantity of heat to be dissipated by the heat sink 142, thereby permitting the heat sink 142 to be formed relatively smaller than otherwise required.

In addition to the above embodiment, those skilled in the art will further recognize additional embodiments of the invention. In another embodiment of the invention, as illustrated in FIGS. 5 and 6, the light source board 150 may be configured to extend beyond a periphery of the intermediate member 130 and the light source board 150 may include an upper surface and a lower surface such that a region of the lower surface may extend beyond the periphery of the intermediate member 130. The plurality of light sources 170 may also include a first plurality of light sources 171 and a second plurality of light sources 172 and the first plurality of light sources 171 may be generally distributed about the upper surface of the light source board 150 and the second plurality of light sources 172 may be generally distributed about the lower surface of the light source board 150.

The controller 160 may be adapted to independently operate each light source 170 of the first plurality of light sources 171 and/or the second plurality of light sources 172.

The light emitted by the light source 170 may be within a wavelength range of at least one of about 10 nanometers to 380 nanometers, about 390 nanometers to 700 nanometers, and about 700 nanometers to 1 millimeter. A portion of the light emitted by the light source 170 may be reflected and/or refracted by the optic in a direction substantially below a generally horizontal plane defined by the upper member 132. At least a portion of the light emitted by the light source 170 that is reflected and/or refracted by the optic may be reflected and/or refracted in the direction of the void 180. A skilled artisan will also appreciate, after having the benefit of this disclosure, that the light emitted by the light source 170 may include additional wavelengths and wavelength ranges.

The luminaire 100 may further include an intermediate optic 121 that may be positioned adjacent to the light source 170 and/or carried by the intermediate member 130 and the intermediate optic 121 may be configured to form a fluid seal between the light source 170 and the optical chamber 122. In order to maintain a fluid seal between the light source 170 and the environment external to the luminaire 100, the luminaire 100 may further include a sealing member. The sealing member may include any device or material that can provide a fluid seal as described above.

The intermediate optic 121 may further include a conversion material and/or a tinted surface. For example, the intermediate optic 121 may be carried by the intermediate member 130 through the use of an adhesive, a glue, a slot and tab system, or any other attachment method known in the art. A skilled artisan will also appreciate, after having the benefit of this disclosure, additional devices and methods that may be used in attaching the intermediate optic 121 to the intermediate member 130.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed.

What is claimed is:

1. A luminaire comprising:

an electrical base;

an optic defining an optical chamber;

an intermediate member positioned between the electrical base and the optic comprising:

a main body, and a plurality of structural supports connected to the main body and configured to carry an upper member, wherein a plurality of voids are positioned between the respective plurality of structural supports to position the optical chamber in optical communication with the environment surrounding the luminaire therethrough; and a light source;

wherein the upper member is configured to carry the optic;

wherein the light source is electrically coupled to the electrical base and positioned within the optical chamber; and wherein the optic is configured to redirect at least a portion of light incident thereupon in the direction of the plurality of voids.

2. The luminaire according to claim 1 further comprising a heat sink that is at least one of carried by and adjacent to the intermediate member.

3. The luminaire according to claim 2 wherein the plurality of voids is configured to position at least one of the optical chamber and the heat sink in fluid communication with the environment surrounding the luminaire.

4. The luminaire according to claim 1 wherein each of the plurality of voids is defined by a pair of the structural supports positioned adjacent to one another, the upper member, and an outer surface of the main body.

5. The luminaire according to claim 1 further comprising a controller to selectively operate the light source.

6. The luminaire according to claim 5 further comprising a light source board electrically coupled to at least one of the light source and the electrical base; and wherein the light source board is configured to facilitate the operation of the light source by the controller.

7. The luminaire according to claim 6 wherein the light source board is carried by the intermediate member.

8. The luminaire according to claim 6 further comprising a power supply unit electrically coupled to at least one of the electrical base, the light source board, the controller, and the light source.

9. The luminaire according to claim 6 wherein the light source comprises a plurality of light sources; wherein the light source board has a circular configuration; and wherein the plurality of light sources are distributed about the light source board.

10. The luminaire according to claim 9 wherein the light source board is configured to extend beyond a periphery of the intermediate member; wherein the light source board comprises an upper surface and a lower surface such that a region of the lower surface extends beyond the periphery of the intermediate member; wherein the plurality of light sources comprises a first plurality of light sources and a second plurality of light sources; wherein the first plurality of light sources are distributed about the upper surface of the light source board; and wherein the second plurality of light sources are distributed about the lower surface of the light source board.

11. The luminaire according to claim 10 wherein the controller is adapted to independently operate each of the light sources in each of the first plurality of light sources and the second plurality of light sources.

12. The luminaire according to claim 1 wherein the optic comprises at least one of a conversion material, a refractive material, a reflective material, a silvered surface, a tinted surface, and a mirrored surface.

13. The luminaire according to claim 1 wherein the light source comprises at least one of a conversion material, a refractive material, and a tinted surface.

14. The luminaire according to claim 1 wherein the light emitted by the light source is within a wavelength range of at least one of about 10 nanometers to 380 nanometers, about 390 nanometers to 700 nanometers, and about 700 nanometers to 1 millimeter.

15. The luminaire according to claim 1 wherein a portion of the light emitted by the light source is at least one of reflected and refracted by the optic in a direction substantially below a generally horizontal plane defined by the upper member.

16. The luminaire according to claim 15 wherein at least a portion of the light emitted by the light source that is reflected or refracted by the optic is reflected or refracted in the direction of the void.

17. The luminaire according to claim 1 wherein the light source comprises a light emitting diode (LED).

18. The luminaire according to claim 1 further comprising an intermediate optic positioned adjacent to the light source and carried by the intermediate member; and wherein the intermediate optic is configured to form a fluid seal between the light source and the optical chamber.

19. The luminaire according to claim 18 wherein the intermediate optic further comprises at least one of a conversion material and a tinted surface.

20. A luminaire comprising:

an electrical base;

an optic defining an optical chamber;

an intermediate member positioned between the electrical base and the optic comprising:

a main body, and a plurality of structural supports connected to the main body and configured to carry an upper member;

wherein a plurality of voids are positioned between the respective plurality of structural supports to position the optical chamber in optical communication with the environment surrounding the luminaire therethrough;

a heat sink at least one of carried by and adjacent to the intermediate member;

a light source board;

a light source comprising a plurality of light sources distributed about the light source board; and an intermediate optic positioned adjacent to the light source and carried by the intermediate member;

wherein the upper member is configured to carry the optic;

wherein the light source is electrically coupled to the electrical base and positioned within the optical chamber;

wherein the optic is configured to redirect at least a portion of light incident thereupon in the direction of the plurality of voids;

wherein each of the plurality of voids is defined by a pair of the structural supports positioned adjacent to one another, the upper member, and an outer surface of the main body; and wherein the light source board is electrically coupled to at least one of the light source and the electrical base.

21. A luminaire comprising:

an electrical base;

an optic defining an optical chamber;

an intermediate member positioned between the electrical base and the optic comprising a main body, and a plurality of structural supports connected to the main body and configured to carry an upper member, wherein a plurality of voids are positioned between the respective plurality of structural supports to position the optical chamber in optical communication with the environment surrounding the luminaire therethrough;

a light source board;

a light source comprising a plurality of light sources wherein the plurality of light sources comprises a first plurality of light sources and a second plurality of light sources; and an intermediate optic positioned adjacent to the light source and carried by the intermediate member;

wherein the upper member is configured to carry the optic;

wherein the light source is electrically coupled to the electrical base and positioned within the optical chamber;

wherein at least one of the optic, the intermediate optic and the light source comprises a conversion material;

wherein the first plurality of light sources are generally distributed about an upper surface of the light source board;

wherein the second plurality of light sources are generally distributed about a lower surface of the light source board;

wherein the light emitted by the second plurality of light sources is emitted in a direction substantially below a horizontal plane defined by the upper member; and wherein the optic is configured to redirect at least a portion of light incident thereupon in the direction of the plurality of voids.

* * * * *